United States Patent [19]

Lutz

[11] 4,420,292

[45] Dec. 13, 1983

[54] BI-DIRECTIONAL INTERNAL/EXTERNAL GEAR PUMP WITH ADVANCED PORTING

[75] Inventor: Timothy P. Lutz, South Bend, Ind.

[73] Assignee: Borg-Warner Corporation, Chicago, Ill.

[21] Appl. No.: 241,894

[22] Filed: Mar. 9, 1981

[51] Int. Cl.[3] ..... F04C 2/04

[52] U.S. Cl. ..... 418/32; 418/61 B; 418/171

[58] Field of Search ..... 418/32, 61 B, 171; 417/135

[56] References Cited

U.S. PATENT DOCUMENTS

| | | | |
|---|---|---|---|
| 2,373,368 | 4/1945 | Witchger | 418/32 |
| 3,834,842 | 9/1974 | Dorff et al. | 418/171 |
| 3,995,978 | 12/1976 | Khan et al. | 418/171 |
| 4,008,018 | 2/1977 | McDermott | 418/171 |
| 4,222,719 | 9/1980 | Johnson | 418/32 |

FOREIGN PATENT DOCUMENTS

| | | | |
|---|---|---|---|
| 630976 | 11/1961 | Canada | 418/171 |
| 2029905 | 3/1980 | United Kingdom | 418/32 |

*Primary Examiner*—Craig R. Feinberg
*Assistant Examiner*—W. R. Wolfe

[57] ABSTRACT

A bi-directional internal/external gear pump with advanced porting includes inlet and outlet ports symmetrical about a line perpendicular to the port centerline. An internal/external gear set is rotatable on parallel axes establishing the hydraulic centerline, which is advanced relative to the port centerline by some predetermined angle. One axis may be revolved about the other to shift the hydraulic centerline by substantially 180° minus twice the angle of advance.

14 Claims, 6 Drawing Figures

BI-DIRECTIONAL INTERNAL/EXTERNAL GEAR PUMP WITH ADVANCED PORTING

BACKGROUND OF THE INVENTION

This invention relates generally to a gear pump. More particularly it relates to a bi-directional gear pump having advanced porting. The pump is of the type incorporating a gerotor gear set wherein internally and externally toothed members cooperate to define successively expanding and contracting fluid cavities during rotation of the members on spaced parallel axes. Fluid flows into expanding cavities and out of contracting cavities through inlet and outlet ports communicating with a chamber in which the members are rotatably mounted.

In such a pump, noise and a fall-off in pump delivery are caused by cavitation. This problem can become excessive where the pump is operated at high speeds, such as in an automotive, marine or industrial application.

One way of eliminating cavitation is by the use of advanced porting. In the typical prior art pump, the inlet port was lengthened and the outlet port shortened (FIG. 2). This extended the time during which each pump cavity was allowed to fill. It also permitted the largest cavity in the pump to begin decreasing in volume while still in fluid communication with the inlet port.

One disadvantage of advanced porting was that it could not be incorporated in a bi-directional pump. This was so because the typical prior art pump required rotation of the hydraulic centerline by 180° when the direction of pump rotation was to be reversed. In order to provide a bi-directional capability, the ports should be symmetrical about a line (line X in FIG. 3) which is perpendicular to the port centerline. Since advanced porting (FIG. 2) did not provide this symmetry, it could not heretofore be incorporated in a bi-directional pump.

Thus, there remains a need in the art for an internal-/external gear pump which is bi-directional and which includes the advantages of advanced porting.

SUMMARY OF THE INVENTION

The primary object of this invention is to meet the need noted above. To that end, there is provided an internal/external gear pump having symmetrical ports which determine a port centerline. The internal and external gears rotate on parallel axes, the eccentricity of which determines a hydraulic centerline. The pump housing is adjustable to thereby displace the hydraulic centerline from the port centerline by some angle of advance. This establishes advanced porting. Bi-directional rotation of the pump is provided through displacement of the hydraulic centerline not by 180° as is typical in the prior art, but by substantially 180° minus twice the angle of advance. This effectively establishes advanced porting for pump operation in the reverse direction.

BRIEF DESCRIPTION OF THE DRAWINGS

The objects and advantages of this invention will become apparent to those skilled in the art upon careful consideration of the specification herein, including the drawings, wherein.

Figure 1:
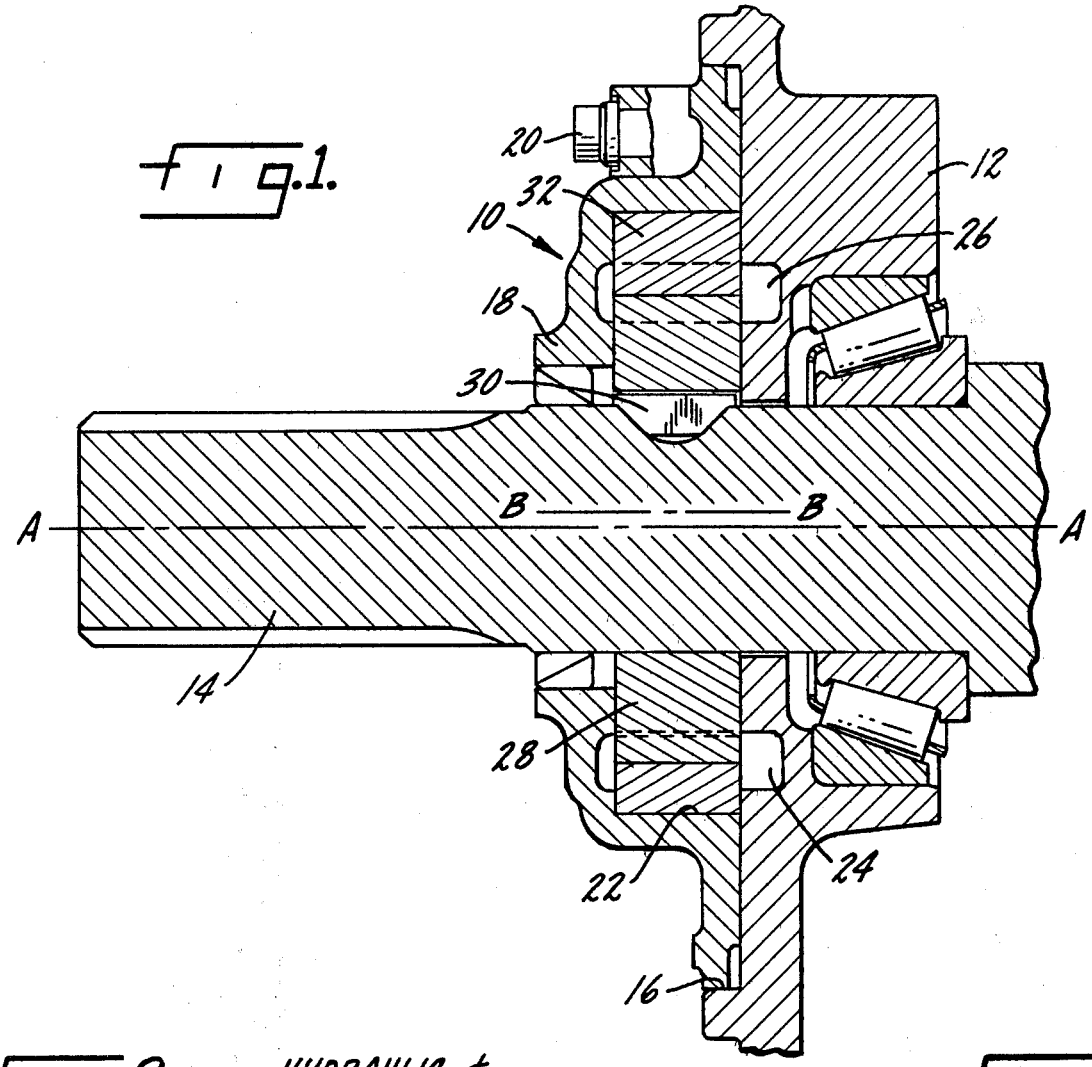
FIG. 1 is a sectional view showing details of the internal/external gear pump.
Figure 2:
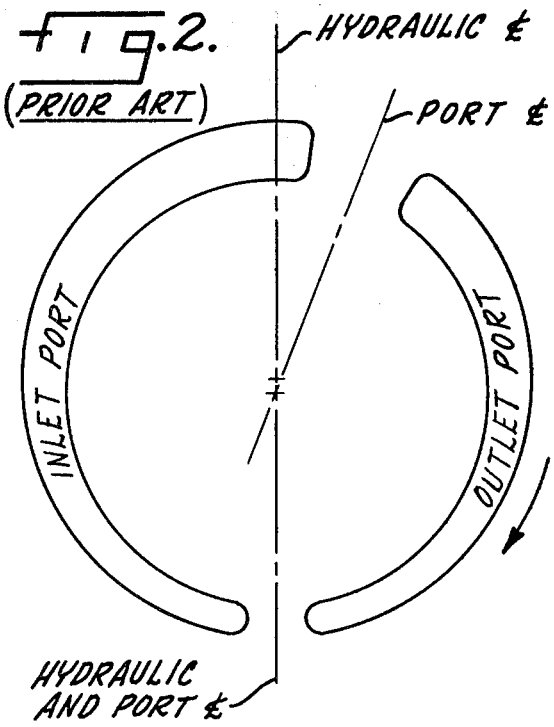
Fig. 2. (PRIOR ART)
FIG. 2 is a diagrammatic view of a typical prior art porting arrangement providing advanced porting and therefore limited to uni-directional pump operation.
Figure 3:
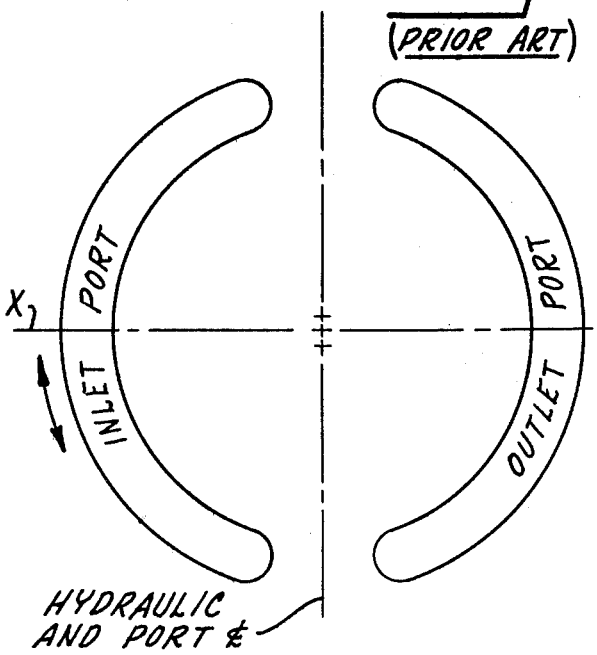
Fig. 3. (PRIOR ART)
FIG. 3 is a diagrammatic view of a typical prior art porting arrangement providing bi-directional operation at the expense of advanced porting.

While this invention is susceptible of embodiment in many different forms, a preferred embodiment shown in the drawings will be described in detail. It should be understood that the present disclosure is considered to be an exemplification of the principles of the invention, and is not intended to limit the invention to this embodiment.

DESCRIPTION OF A PREFERRED EMBODIMENT

Referring to the drawings in further detail, there is shown generally an internal/external gear pump 10 with a housing including a pump body 12. This may be the body of an associated transmission, for example. Pump drive is provided by a shaft 14 rotatable on a first axis A. Shaft 14 may be the transmission input shaft. Body 12 defines an annular groove 16 concentric about axis A.

The housing also includes a pump cover 18 received within groove 16 and secured to body 12 by a plurality of bolts 20 or the like, one of which is shown in the drawings. Cover 18 defines an annular chamber 22 concentric about a second axis B parallel to and spaced from axis A.

Figure 4:
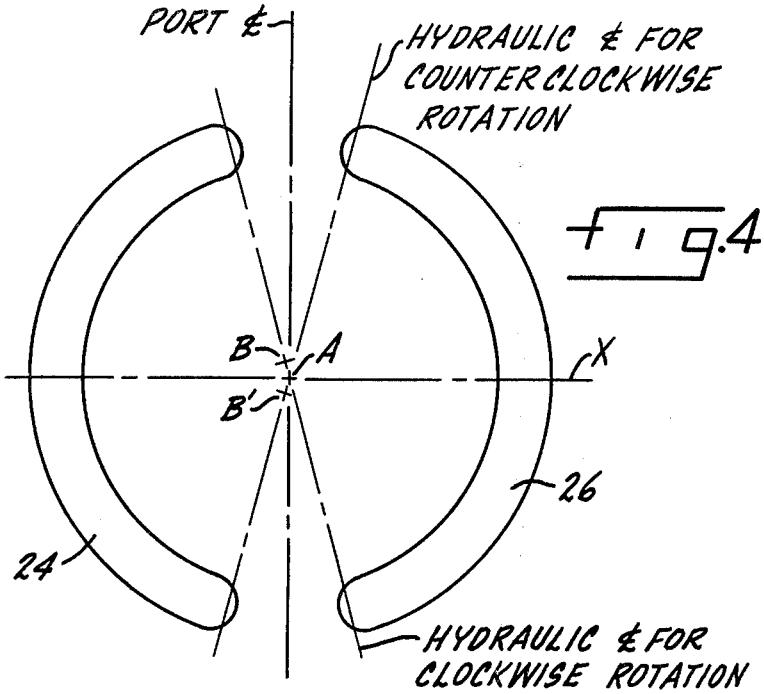
FIG. 4 is a diagrammatic view of the porting arrangement of this invention showing the relationship of the symmetrical ports and the port and hydraulic centerlines, providing both bi-directional operation and advanced porting.

Body 12 defines spaced inlet and outlet ports 24 and 26 respectively. The orientation of ports 24 and 26 determines a fixed port centerline (FIG. 4). In a preferred form of the invention, ports 24 and 26 are symmetrical about a line X perpendicular to the port centerline.

An internal or star gear 28 is secured to shaft 14 by a key 30 or other suitable means. Gear 28 rotates with shaft 14 on axis A. An external or ring gear 32 is received within chamber 22, and is rotatable about axis B. Gears 28 and 32 form a gerotor gear set.

The eccentricity of axes A and B determines the hydraulic centerline. By rotating cover 18 within groove 16, axis B may be revolved around axis A. Thus, the hydraulic centerline may be advanced relative to the port centerline.

With particular reference to FIG. 4, assume that the pump is rotating in the clockwise direction and that axes A and B determine the hydraulic centerline. This hydraulic centerline is advanced by some perdetermined angle relative to the port centerline, and in a preferred form of the invention intersects ports 24 and 26. Thus, pump 10 affords the advantage of advanced porting.

To prepare pump 10 for rotation in the counterclockwise direction, bolts 20 are loosened and cover 18 is rotated within groove 16. Axis B is revolved about axis A to position B′, whereupon bolts 20 are tightened. The hydraulic centerline has not been rotated 180° as taught in the prior art. Rather, the hydraulic centerline has been rotated substantially 180° minus twice the angle of advance. Counterclockwise pump rotation with the advantages afforded by advanced porting is thus provided.

As an example, if it is assumed that the angle of advance is 15°, the hydraulic centerline is rotated 150° when the direction of rotation of shaft 14 is to be reversed.

Figure 5:
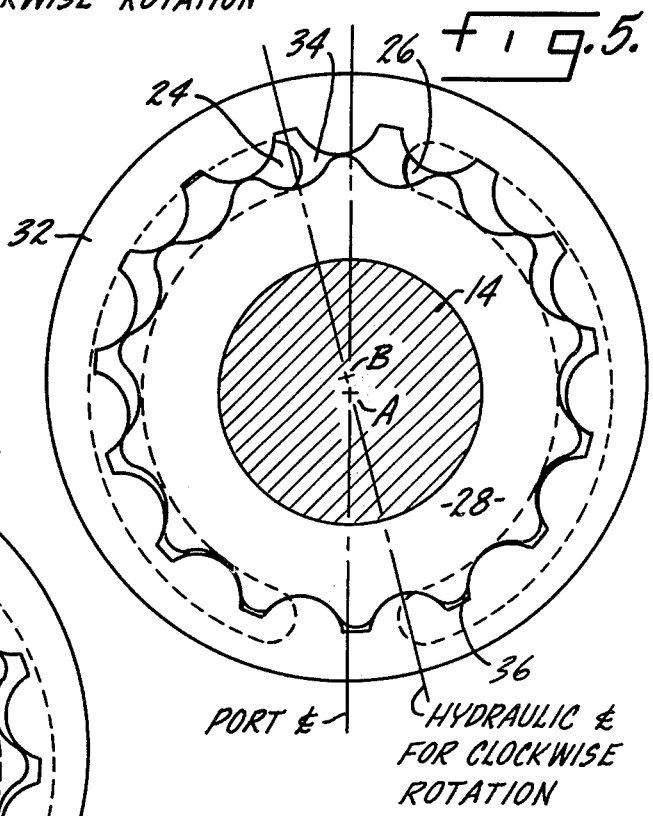
FIG. 5 is a partial sectional view showing details of the relationship of the gears and ports.

FIG. 5 shows the pump rotating in the clockwise direction with cavity 34 having its maximum volume on the hydraulic centerline. At this point, cavity 34 is still in fluid communication with inlet port 24. Thereafter, as cavity 34 counteracts, it remains in communication with inlet port 24 for a short period of time, thereby eliminating cavitation.

Figure 6:
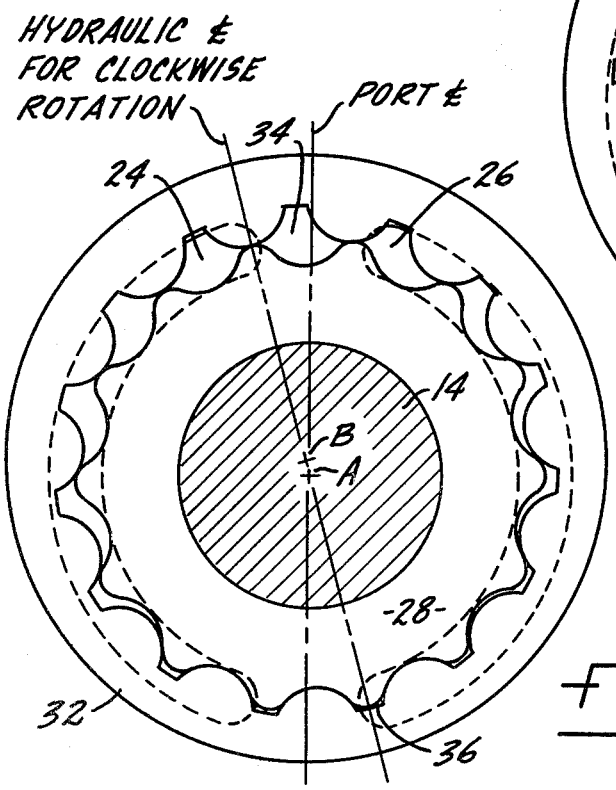
FIG. 6 is a partial sectional view similar to FIG. 5 showing additional details of the relationship of the gears and ports.

FIG. 6 shows the pump rotating in the clockwise direction with cavity 36 at its minimum volume on the hydraulic centerline. At this point, cavity 36 is still in fluid communication with outlet port 26. As a result, cavity 36 is expanding rather than contracting as it moves out of fluid communication with outlet port 26. This reduces or eliminates trapping of fluid in the smallest cavity, thus avoiding another source of noise. Further, if the hydraulic centerline is far enough ahead of the port centerline, cavity 36 begins to fill while still in communication with outlet port 26. This reduces the time required to fill cavity 36 completely as it moves across inlet port 24, and improves high-speed pump operation.

It will be seen that the invention disclosed herein provides a simple, inexpensive, efficient, easily adjusted bi-directional internal/external gear pump having the advantages of advanced porting.

It is not intended that the present invention be restricted in its application to a pump, but rather that it may be applied as well to a motor or the like.

It should be understood that while a preferred embodiment of the invention has been shown and described, this is to be considered as illustrative and may be modified by those skilled in the art. It is intended that the claims herein cover all such modifications as may fall within the spirit and scope of the invention.

What is claimed is:

1. Bi-directional fluid displacement apparatus comprising a housing including a body defining an annular groove concentric about a first axis, said body also defining inlet and outlet ports with a port centerline, said ports being symmetrical about a line perpendicular to said port centerline, said housing also including a cover received in said groove, said cover defining an annular chamber concentric about a second axis parallel to said first axis, said chamber being in fluid communication with said inlet and outlet ports, a shaft journalled in said housing for rotation on said first axis, an internal-/external gear set in said chamber, said internal gear being secured to said shaft for rotation therewith on said first axis, said external gear being rotatable on said second axis, said axes establishing the hydraulic centerline of said gear set, said cover having a first position wherein said hydraulic centerline is advanced relative to said port centerline by a predetermined angle of advance, said cover being rotatable to a second position wherein said hydraulic centerline is rotated substantially 180° minus twice said angle of advance, and means for securing said cover to said body in said first and second positions, said apparatus being constructed and arranged such that said hydraulic centerline intersects said inlet and outlet ports when said cover is in said first and second positions.

2. Fluid displacement apparatus comprising a housing defining inlet and outlet ports with a port centerline, said housing also defining a chamber in fluid communication with said ports, a gear set in said chamber including an externally toothed star gear rotatable on a first axis and an internally toothed ring gear rotatable on a second axis parallel to said first axis, said axes determining the hydraulic centerline of said gear set, and means establishing a first position for said hydraulic centerline in which it has a first angle of advance relative to said port centerline for rotation of said gears in one direction and a second position for said hydraulic centerline in which it has a second angle of advance relative to said port centerline for rotation of said gears in the opposite direction, said positions being spaced by substantially 180° minus the sum of said angles of advance.

3. The invention of claim 2, said angles of advance being equal.

4. The invention of claim 2, said angles of advance being such that said hydraulic centerline intersects said ports.

5. The invention of claim 2, 3 or 4, said housing having a body defining said ports and a cover defining said chamber, said cover being shiftable to first and second positions relative to said body to thereby shift said second axis relative to said first axis by substantially 180° minus the sum of said angles of advance to thus relatively establish said first and second angles of advance.

6. The invention of claim 3, said angles of advance being such that said hydraulic centerline intersects said ports.

7. The invention of claim 6, said housing having a body defining said ports and a cover defining said chamber, said cover being shiftable to first and second positions relative to said body to thereby shift said second axis relative to said first axis by substantially 180° minus the sum of said angles of advance to thus respectively establish said first and second angles of advance.

8. A bi-directional internal/external gear pump with advanced porting comprising a housing defining a chamber and inlet and outlet ports with a port centerline, an internal/external gear set in said chamber for drawing fluid from said inlet port into expanding cavities defined by diverging meshing teeth of said gear set and for displacing fluid to said outlet port from contracting cavities defined by converging meshing teeth of said gear set, said gear set having a hydraulic centerline with a first angle of advance relative to said port centerline for pump rotation in one direction and a substantially equal second angle of advance relative to said port centerline for pump rotation in the opposite direction.

9. The invention of claim 8, said internal and external gears being rotatable respectively on first and second axes, said housing being adjustable to fix said second axis in first and second positions relative to said first axis determining respectively said first and second angles of advance.

10. The invention of claim 9, said first and second angles of advance being spaced by substantially 180° minus twice one angle of advance.

11. The invention of claim 8, said ports being symmetrical about a line perpendicular to said port centerline.

12. The invention of claim 11, said first and second angles of advance being such that said hydraulic centerline intersects said inlet and outlet ports.

13. The invention of claim 112, said housing including a body and a cover defining said chamber, said cover having first and second positions relative to said body respectively establishing said first and second angles of advance.

14. The invention of claim 13, said internal gear being rotatable on a first axis fixed with respect to said body, and said cover defining a second axis eccentric to said first axis, said external gear being rotatable on said second axis, said second axis being shifted relative to said first axis by substantially 180° minus twice said angle of advance as said cover is shifted between its first and second positions.

* * * * *

UNITED STATES PATENT AND TRADEMARK OFFICE

CERTIFICATE OF CORRECTION

PATENT NO. : 4,420,292

DATED : December 13, 1983

INVENTOR(S) : TIMOTHY P. LUTZ

It is certified that error appears in the above—identified patent and that said Letters Patent is hereby corrected as shown below:

Column 5, line 4, cancel "112" and insert -- 12 --.

Signed and Sealed this

*Fourteenth* Day of *February 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,420,292

DATED : December 13, 1983

INVENTOR(S) : TIMOTHY P. LUTZ

It is certified that error appears in the above—identified patent and that said Letters Patent is hereby corrected as shown below:

On the front page of the patent, please show Julian Schachner as "Attorney".

Signed and Sealed this

*Seventeenth* Day of *July 1984*

[SEAL]

*Attest:*

GERALD J. MOSSINGHOFF

*Attesting Officer*

*Commissioner of Patents and Trademarks*